US009192802B2

(12) United States Patent
Pearce et al.

(10) Patent No.: US 9,192,802 B2
(45) Date of Patent: Nov. 24, 2015

(54) WHEELED EXERCISE APPARATUS

(71) Applicants: Melissa Pearce, The Woodlands, TX (US); Richard Pearce, The Woodlands, TX (US)

(72) Inventors: Melissa Pearce, The Woodlands, TX (US); Richard Pearce, The Woodlands, TX (US)

(73) Assignee: FROG FITNESS, INC., The Woodlands, TX (US)

( * ) Notice: Subject to any disclaimer, the term of this patent is extended or adjusted under 35 U.S.C. 154(b) by 164 days.

(21) Appl. No.: 13/926,452

(22) Filed: Jul. 29, 2013

(65) Prior Publication Data

US 2013/0310231 A1 Nov. 21, 2013

Related U.S. Application Data

(63) Continuation-in-part of application No. 13/890,083, filed on May 8, 2013, now abandoned.

(60) Provisional application No. 61/644,238, filed on May 8, 2012.

(51) Int. Cl.

| | |
|---|---|
| ***A63B 26/00*** | (2006.01) |
| ***A63B 21/02*** | (2006.01) |
| ***A63B 21/00*** | (2006.01) |
| ***A63B 21/055*** | (2006.01) |
| ***A63B 22/20*** | (2006.01) |
| ***A63B 23/02*** | (2006.01) |
| ***A63B 23/12*** | (2006.01) |

(Continued)

(52) U.S. Cl.

CPC ..... *A63B 21/02* (2013.01); *A63B 21/0004* (2013.01); *A63B 21/0428* (2013.01); *A63B 21/0552* (2013.01); *A63B 21/0557* (2013.01); *A63B 21/143* (2013.01); *A63B 22/20* (2013.01); *A63B 23/0222* (2013.01); *A63B 23/1236* (2013.01); *A63B 21/00069* (2013.01); *A63B 21/1469* (2013.01); *A63B 21/1488* (2013.01); *A63B 2071/0072* (2013.01); *A63B 2208/0295* (2013.01)

(58) Field of Classification Search

CPC ..... A63B 21/02; A63B 21/0428; A63B 21/0004; A63B 21/143; A63B 22/20; A63B 23/1236; A63B 21/0557; A63B 23/0222; A63B 21/0552; A63B 2071/0072; A63B 21/1469; A63B 21/1488; A63B 2208/0295; A63B 21/00069

USPC ..... 280/1.175, 1.181, 1.182

See application file for complete search history.

(56) References Cited

U.S. PATENT DOCUMENTS

| | | | | |
|---|---|---|---|---|
| 1,997,139 | A * | 4/1935 | Gardener et al. | 482/132 |
| 2,131,570 | A * | 9/1938 | Riley | 482/72 |
| 3,589,720 | A * | 6/1971 | Agamian | 482/114 |

(Continued)

*Primary Examiner* — Oren Ginsberg
*Assistant Examiner* — Gary D Urbiel Goldner
(74) *Attorney, Agent, or Firm* — The Concept Law Group, P.A.; Scott D. Smiley; Erin A. Martin

(57) ABSTRACT

A wheeled exercise apparatus has at least two resistance bands. A first and second axle each have a wheel assembly rotatably connected at an opposite end thereof. The axles are connected at each of the opposite ends by at least one of the resistance bands so that the apparatus operates in a rolling extending and collapsing motion within an elastic region. A pedal assembly is axially connected to the second axle. The pedal/foot supporting assembly is capable of supporting and securing both feet of the person so that the person is capable of exerting stress when griping the first axle with the person's hands and pushing against the second axle with the person's feet while exercising in a substantially prone position.

19 Claims, 4 Drawing Sheets

(51) Int. Cl.

| | |
|---|---|
| ***A63B 21/04*** | (2006.01) |
| *A63B 71/00* | (2006.01) |

(56) References Cited

U.S. PATENT DOCUMENTS

| | | | | | |
|---|---|---|---|---|---|
| 3,752,475 | A * | 8/1973 | Ott | 482/127 |
| 3,895,795 | A * | 7/1975 | Merz | 482/8 |
| 4,225,132 | A * | 9/1980 | Archambault | 482/125 |
| 4,515,362 | A * | 5/1985 | Lin | 482/51 |
| 4,595,197 | A * | 6/1986 | Hagstrom et al. | 482/132 |
| 4,647,035 | A * | 3/1987 | Yellen | 482/72 |
| 5,004,229 | A * | 4/1991 | Lind | 482/132 |
| 5,176,595 | A * | 1/1993 | Lind | 482/51 |
| 5,224,909 | A * | 7/1993 | Hamilton | 482/70 |
| 5,261,866 | A * | 11/1993 | Mattox | 482/125 |
| 5,447,483 | A * | 9/1995 | Liang | 482/132 |
| 5,499,961 | A * | 3/1996 | Mattox | 482/132 |
| 5,518,483 | A * | 5/1996 | Oswald | 482/131 |
| 5,669,864 | A * | 9/1997 | Brister | 482/132 |
| 6,053,853 | A * | 4/2000 | Hinds | 482/132 |
| 6,071,217 | A * | 6/2000 | Barnett | 482/121 |
| 6,203,476 | B1 * | 3/2001 | Wang et al. | 482/121 |
| 6,306,065 | B1 * | 10/2001 | Liang | 482/51 |
| 6,371,891 | B1 * | 4/2002 | Speas | 482/57 |
| 6,500,105 | B1 * | 12/2002 | Kuo | 482/123 |
| 6,746,383 | B2 * | 6/2004 | Yu | 482/127 |
| 7,204,790 | B2 * | 4/2007 | Sleamaker | 482/96 |
| 7,407,465 | B1 * | 8/2008 | Alzamora et al. | 482/51 |
| 7,780,585 | B1 * | 8/2010 | Rivas | 482/140 |
| 7,794,375 | B1 * | 9/2010 | Jackson et al. | 482/132 |
| 2002/0151416 | A1 * | 10/2002 | List | 482/121 |
| 2003/0022770 | A1 * | 1/2003 | Lee | 482/136 |
| 2003/0050153 | A1 * | 3/2003 | Stevens | 482/92 |
| 2004/0077468 | A1 * | 4/2004 | Myles et al. | 482/140 |
| 2004/0241631 | A1 * | 12/2004 | Nizamuddin | 434/253 |
| 2006/0035752 | A1 * | 2/2006 | Chang | 482/51 |
| 2009/0105050 | A1 * | 4/2009 | Mayo | 482/70 |
| 2010/0216615 | A1 * | 8/2010 | Rios et al. | 482/142 |
| 2011/0275482 | A1 * | 11/2011 | Brodess et al. | 482/8 |
| 2012/0108405 | A1 * | 5/2012 | Milo | 482/142 |
| 2013/0017938 | A1 * | 1/2013 | Thompson | 482/145 |
| 2013/0123081 | A1 * | 5/2013 | Boland | 482/141 |

* cited by examiner

WHEELED EXERCISE APPARATUS

CROSS REFERENCE TO RELATED APPLICATIONS

Pursuant to 35 U.S.C. 120, the Applicant claims the benefit of U.S. Ser. No. 13/890,083 filed May 8, 2013, pursuant to 35 U.S.C. 111(a), which claims the benefit, pursuant to 35 U.S.C. 119(e), of U.S. Ser. No. 61/644,238, filed 8 May, 2012, pursuant to 35 U.S.C. 111(b).

STATEMENT OF FEDERALLY SPONSORED RESEARCH

Not Applicable.

BACKGROUND OF THE INVENTION

1. Field of the Invention

The present invention relates to wheeled exercise devices. In particular, it relates to a wheeled exercise device capable of adjustable resistance and locomotion.

2. Description of the Related Art

Wheeled exercise devices are known for use in exercising different muscle groups of the upper body and torso in a prone position. U.S. Pat. No. 5,261,866, to Mattox discloses a wheeled exercise device which employs a central wheel rotatably mounted on an axle. A pair of handgrips is telescopically mounted on the axle ends. A length of elastic tubing is telescopically connected mounted to the opposite ends of the axle. A pair of foot pads is adjustably mounted on the elastic tubing. The pads may be moved to different points along the length of the tubing to accommodate users of different size and strength. The user kneels or stands on the pads, grips the hand grips, and rolls the wheel and axle forward, away from, the pads until the user is in the prone position. Thereafter, the user rolls the axle wand wheel backward, until the starting position is reached.

U.S. Pat. No. 6,203,476 to Wang et. al. describes a physical exercising apparatus which includes a first transverse frame bar having a longitudinal center through hole, a second transverse frame bar, two wheels respectively mounted on wheel holders for supporting the second transverse frame bar on the floor, and a single elastic cord member inserted through the longitudinal center through hole on the first transverse frame bar and connected between the wheel holders for stretching by the user when the user holds the first transverse frame bar in place and moves the second transverse frame bar relative to the first transverse frame bar.

While the foregoing exercise devices offer some utility, the devices are limited in use for outward extension of the handle portion against the resistance of the elastic tubing. Thus, such devices are limited in capability for use in exercising the muscle groups of the lower torso and legs and aerobic conditioning. In addition, such devices are mostly incapable of achieving high degrees of resistance. Thus, what is needed is an exercise apparatus which uses a pair of wheeled straight axle members connected at the opposite ends thereof by one or more resistance bands so that when exercising in the prone position the user is capable of exercising both the upper and lower muscle groups and enhancing aerobic conditioning. The present invention satisfies these needs.

BRIEF SUMMARY OF THE INVENTION

It is therefore an object of the present invention to provide a wheeled exercise device which combines isotonic exercise of the upper and lower muscle groups with aerobic conditioning in a fluid and seamless movement.

It is another object of the present invention to provide a wheeled exercise device adapted for indoor and outdoor use.

It is yet another object of the present invention to provide a wheeled exercise device for locomotion on an inclined plane.

To overcome the problems associated with the prior art and in accordance with the purpose of the present invention, as embodied and broadly described herein, briefly, a wheeled exercise apparatus is provided. A wheeled exercise apparatus has at least two resistance bands. The bands have an elastic region which is less than an elastic limit with a relative change in dimension which is proportional to an applied stress exerted by a person to be exercised. A first and a second axle each have a wheel assembly rotatably connected at an opposite ends thereof. The axles are connected at each of the opposite ends by at least one of the resistance bands so that the apparatus operates in a rolling extending and collapsing motion within the elastic region. A pedal assembly is axially connected to the second axle. The pedal assembly is capable of supporting and securing both feet of the person so that the person is capable of exerting the stress when gripping the first axle with the person's hands and pushing against the second axle with the person's feet on the pedal assembly while exercising in a substantially prone position.

Additional advantages of the present invention will be set forth in part in the description that follows and in part will be obvious from that description or can be learned from practice of the invention. The advantages of the invention can be realized and obtained by the method particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and, together with the description, explain the principles of the invention.

DETAILED DESCRIPTION OF THE DRAWINGS

Figure 1:
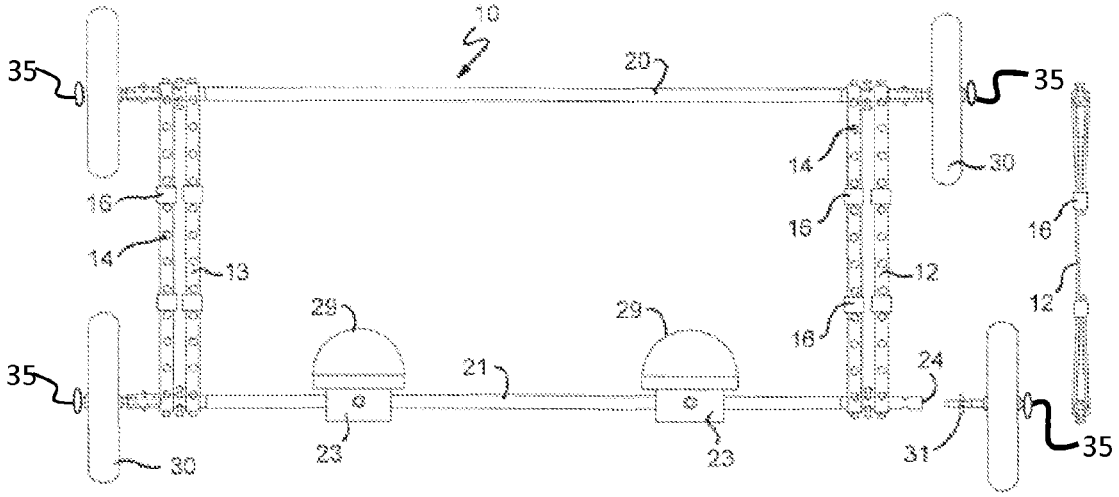
FIG. 1 is top view of an embodiment of the present invention.
Figure 2:
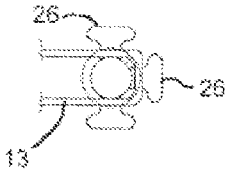
FIG. 2 is a cross sectional view of an end portion of an axle showing an embodiment where pins engage the resistance bands for securing the resistance bands to the axle.
Figure 3:
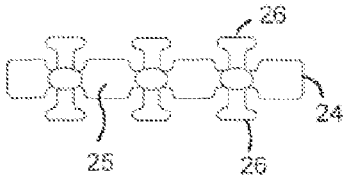
FIG. 3 is a side view of the end portion shown in FIG. 2.
Figure 4:
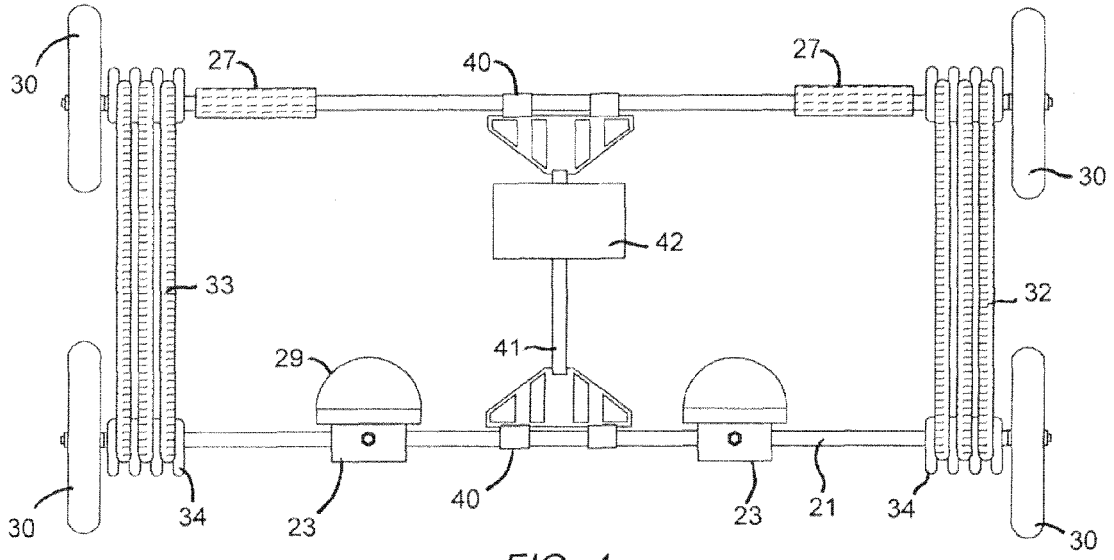
FIG. 4 is a top view of the presently preferred embodiment of the present invention showing the safety damper in a position which limits travel of the axles within the elastic region of the resistance bands.
Figure 5:
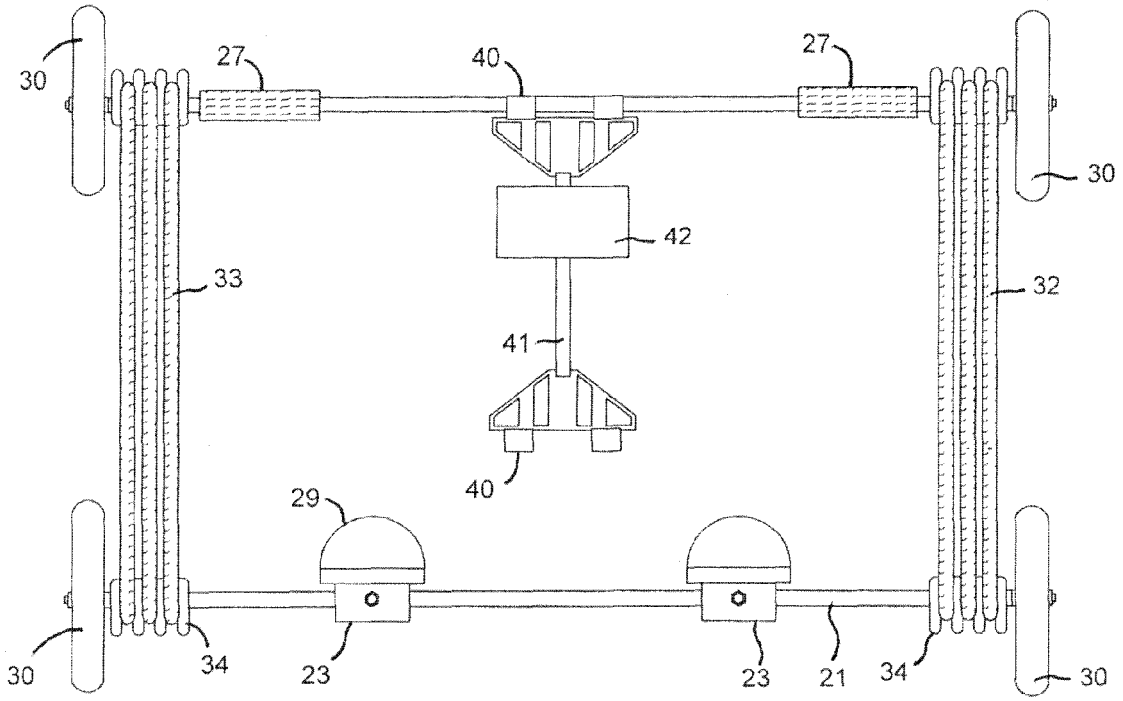
FIG. 5 is a top view of the embodiment shown in FIG. 4 which illustrates the safety damper is a position where an applied stress is exerted against the first and second axles with the hands and feet of a person to be exercised.
Figure 6:
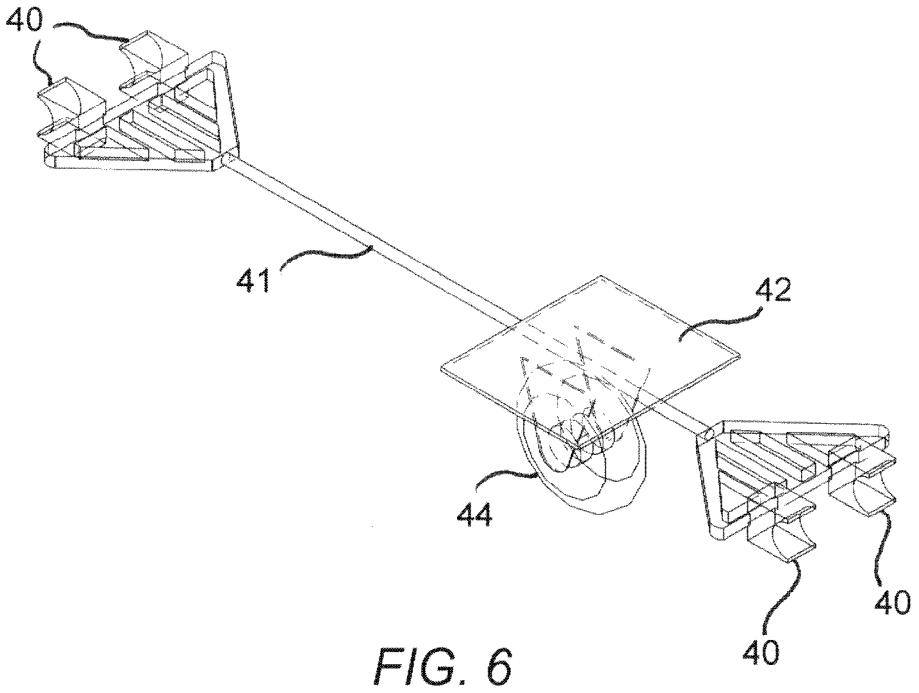
FIG. 6 is an isometric top view of a preferred embodiment of the safety damper.
Figure 7:
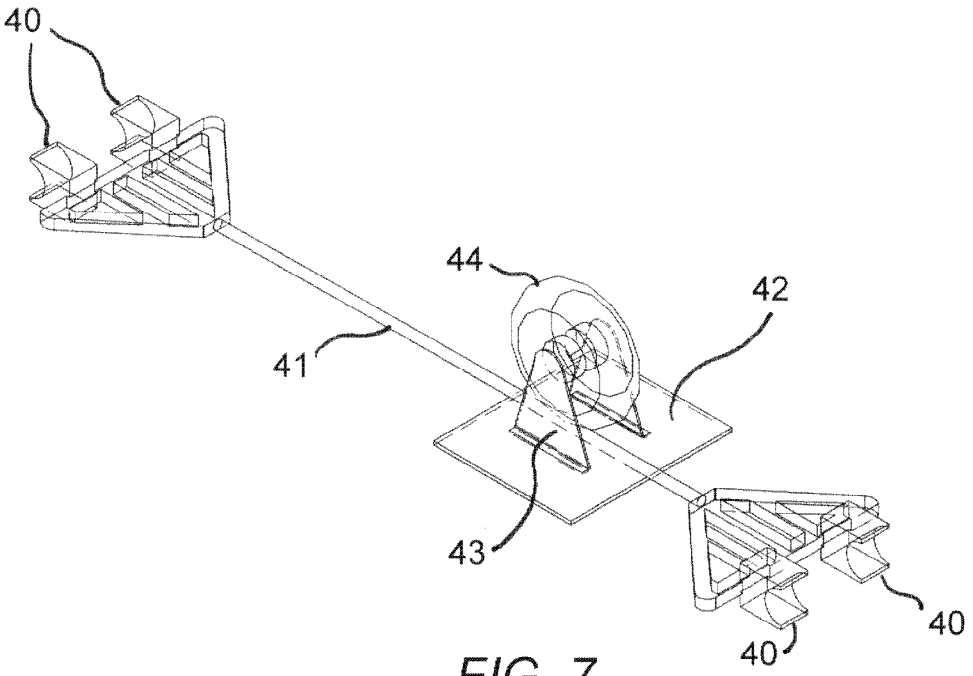
FIG. 7 is an isometric bottom view of the embodiment of the safety damper shown in FIG. 6.
Figure 8:
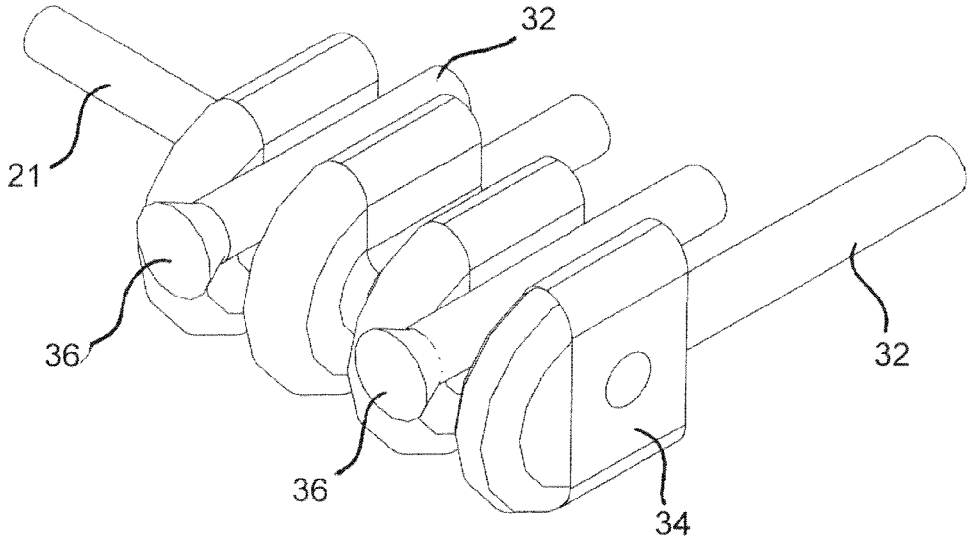
FIG. 8 is an enlarged isometric back view of a clip embodiment where the resistance bands are a length with enlarged tapered ends for stopping travel of the resistance bands through the clip as shown in the illustration of the preferred embodiment according to FIG. 4.
Figure 9:
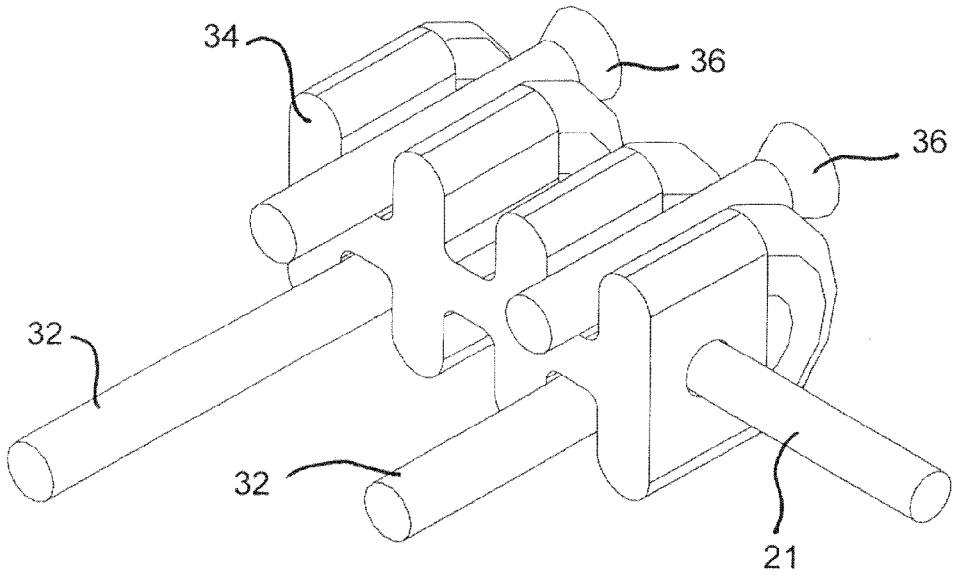
FIG. 9 is an enlarged isometric front view of the clip embodiment shown in FIG. 8.

Unless specifically defined otherwise, all technical or scientific terms used herein have the same meaning as commonly understood by one of ordinary skill in the art to which this invention belongs.

Although any methods and materials similar or equivalent to those described herein can be used in the practice or testing of the present invention, the preferred methods and materials are now described. Reference now will be made in detail to the presently preferred embodiments of the invention, examples of which are illustrated in the accompanying drawings, wherein like numerals represent like features.

The present invention provides a wheeled exercise apparatus 10 for concurrent upper and lower body isotonic exercise combining functionality, strength, power, and cardiovascular health while exercising in a prone or upright position. The apparatus 10 includes at least two resistance bands 12, 13. A first and a second straight axle 20, 21 include a transverse pair of wheeled assemblies 30 on opposite ends. The first and second straight axles 20, 21 are also connected at the opposite ends by the resistance bands 12, 13. At least one pedal support member 23 is connected to the second straight axle 21 between the wheeled assemblies 30 and the resistance bands 12, 13.

The first and the second straight axles 20, 21 are desirably constructed of an alloy, but may be constructed of any metal or plastic material in the form of a bar, tube or any combination thereof which is well known in the art. The straight axle ends may be constructed so that the end portions thereof include tubular sections 24, having clear holes, for receiving quick release pins 31 capable of securing the wheeled assemblies 30 in the tubular sections 24 of the straight axle ends. In this manner, the wheeled assemblies 30 are easily disconnected, or snap out of, from the straight axles 20, 21 when not in use.

The wheeled assemblies 30, may, but need not, include a clutch mechanism 35 for alternating engagement of the wheels, of the wheeled assemblies 30, between freewheel or unidirectional rotation. When engaged for unidirectional rotation the user is able to travel forward or backward while exercising in a prone position. In a preferred embodiment, the clutch 35 is a one-way freewheel clutch, such as a sprag clutch. A sprag clutch is a one-way freewheel clutch, and resembles a roller bearing, but instead of cylindrical rollers, non-revolving asymmetric figure-of-eight shaped sprags are used. When the unit rotates in one direction the rollers slip or free-wheel, but when a torque is applied with the feet or hands in the opposite direction, the rollers tilt slightly, producing a wedging action and binding because of a friction force.

The resistance bands 12, 13 are constructed, at least in part of any resilient elastic material which is well known in the art. The resistance bands work form variety of strengthening exercises. The bands 12, 13 allow the user to target specific areas of the body and work the muscles from different angles for a more complete resistance workout. Both natural rubber latex and synthetic rubber may, but need not, be used in the manufacture resistance bands. In the preferred embodiment, the resistance bands are natural rubber so as to provide greater strength and elasticity. The resistance bands 12, 13 may, for example, be of a solid rubber construction, constructed of with a plurality of extruded rubber strands that are bound to make a strong band, with an over-layered band having a strip of rubber that overlaps, or with a layered on mandrills style construction of the band in layers, with each layer stopping at a different location along the band.

In one embodiment, the exercise apparatus includes a series of paired resistance bands in a system whereby each band provides an increasingly greater peak resistance, or work energy, when extended. This system provides a range of work energy throughout the elastic region so that the user is capable of building strength progressively, and to thereby reduce the risk of muscular injury or damage. To accommodate differing training motions, the user simply chooses a one or more of the bands, in the series of the system, to accommodate the desired predetermined work energy to be expended in each repetition of a set. This allows the user to customize each repetition in a given workout routine and progress through the increasing levels of work energy throughout the elastic region as his or her strength increases. The varying levels of work energy are desirably indicated with the system by unique color coding of the resistance bands in the series so that a predetermined level of resistance is easily identified by the user.

In FIG. 1, the straight axles 20, 21 include pulley shaped end portions 25 proximal to the wheel assemblies 30. The pulley shaped portions 25 define a groove, or channel, having a plurality of radially extending pin formations 26. With this embodiment, the resistance bands 12, 13 are constructed with ends thereof having a plurality of evenly spaced clear holes 14. Fasteners 16, such as a clip, or a hook and loop tie, are provided for securing the ends of the resistance bands into a looped formation with the inner margins of the looped ends, of the resistance bands 12, 13, secured to the radially extending pin formations 26 extending through the clear holes 14. In this manner, the bands 12, 13 are adjustable to a predetermined length depending on the physical stature of the user, to be exercised, or the desired exercise to be preformed.

Drawing FIGS. 4, 5, 8, and 9 illustrate the presently preferred embodiment where the resistance bands 32, 33 are configured with tapered ends 36 so that the bands 32, 33 are capable of being releasably fastened to the clips 34. Here, the clips 34 are desirably constructed of a polymer such as injection or rotationally molded plastic with channels, or grooves for securing the bands 32.

The first straight axle 20 desirably includes a foam rubber handle grip 27 positioned centrally and extending between the pulley shaped formations. The second straight axle 21 preferably includes a pair of pedal shaped platforms 23, one each for supporting a foot of the user, rigidly attached to the second straight axle 21 with a threaded fastener, rivet, or weld. The pedal shaped platforms 23 desirably include straps 29 for holding the feet securely against the platforms 23 when the user is exercising in a pulling motion with respect to the platforms 23.

Referring now to FIGS. 4-7, in yet another embodiment of the present invention, the exercise apparatus 10 includes a damper assembly adapted to limit a range of said collapsing motion within the elastic region of the resistance bands 32, 33, upon release of an applied stress by the user. In this manner, the damper assembly provides a safety stop against the relative collapsing motion of the axles 20, 21 once the person exercising has reached a maximum sustainable exertion against the resistance bands with any given repetition.

The damper assembly includes a transverse damper frame which is capable of spanning a predetermined distance between the axles 20, 21. The frame has oppositely aligned end members which are joined end-to-end with a longitudinal member 41. The ends members are preferably configured as built up member including an interior truss-like member with polymer concave faced clips fastened to distal edges of the truss-like members. The end members have outer concave faced surfaces 40 which are adapted to openly couple with the axles 20, 21. Each of the end members have a distal face 40 which is configured to securely bias against the axles 20, 21, preferably at a midpoint thereof. The distal faces 40 may, but need not, be configured as a concave face having an arc interior diameter slightly greater that the exterior diameter of the axles 20, 21, With the presently preferred embodiment, the concave faces 40, which are positioned in alignment to receive the first axle 20, also include a pin or lever (not shown) which is operable to releasably secure the faces 40 of the end member to the first axle 20 so that the damper frame cooperates with the forward and backward rolling motion of the first axle 20 while exercising.

The damper assembly also includes a rolling horizontal support element 42. The support elements has upper and lower surfaces, a vertical bracket 43, and a third axle and wheel assembly 44. The upper surface of the horizontal support 42 is adapted for supporting the ventral torso of the person while exerting a fully extended stress on the resistance bands 32, 33, in a prone position. The lower surface is rigidly connected to the longitudinal member 41. The vertical bracket 43 includes an upper portion and a lower portion. The upper portion is connected to the lower surface of the horizontal support 42, and the lower portion includes axially aligned clear holes adapted to receive the third axle and wheel assembly.

In use, the present invention allows the user a flexibility to exercise either in a confined space, or by locomotion in an open space, such as a large gymnasium or on an outdoor path including an incline. When exercising in a confined location, the wheeled assemblies 30 are disengaged, in a freewheeling condition, so that the user generally stays in the same position relative to the space, with the force of the bands 12, 13 returning each of the straight axles 20, 21 back into position with repetitive equal and opposite motions of the arms and legs. For locomotion, the user simply engages the one-way clutch and operates the first and second straight axles so that the expansive and contractive forces cause the entire device to travel, with each repetition, in a forward or rearward directions depending on the desired result.

The present invention may, but need not, be further adapted to include adjustable foot straps 29 so that the second straight axle may be inverted, with the user being capable of standing on the strap 29 and performing those exercises such as squats, military presses, curls, and/or triceps extensions. When performing such exercises it is desirable to un-snap and release the wheel assemblies from the tube ends of the straight axles for ease in use. However, when exercising in the prone position, with the hands gripping the first straight axle and the feet supported on the platform members, the wheel assemblies are snap locked back into their respective positions on opposing ends of the straight axles. In this manner, the present invention allows versatility in its capability to provide a complete isotonic body resistance and aerobic training system. The primary principal in burning calories, shredding fat and building muscle is rather basic with the more muscle fiber that is under stress for the longer period of time to equal the maximum amount of calories burned per unit time. When used for its primary purpose "in the prone position" the present invention forces the user to use every muscle in the lower body "just like doing squats", and, at the same time, using every muscle in the upper body "just like military presses". Most importantly, the motion of the wheels requires that the core be constantly engaged, like using an abdominal wheel as illustrated in the prior art, and accomplishes cardiovascular conditioning.

While the present invention has been described in connection with the illustrated embodiments, it will be appreciated and understood that certain modifications may be made without departing from the true spirit and scope of the invention.

We claim:

1. A wheeled exercise apparatus comprising:

at least two resistance bands;

a first and a second axle, each of said first and second axles having a wheel assembly rotatably connected at each end thereof, whereby said first and second axles are connected by the at least two resistance bands so that said apparatus operates in a rolling extending and collapsing motion and said first and second axles are only connected to one another by the at least two resistance bands when in the rolling extending motion; and a foot supporting assembly connected to said second axle, wherein said foot supporting assembly is capable of supporting and securing both feet of a person so that said person is capable of operating said apparatus in the rolling extending and collapsing motion when gripping said first axle with said person's hands and pushing against said second axle with said person's feet while exercising in a substantially prone position.

2. The exercise apparatus according to claim 1, wherein said wheel assemblies further include a one-way free wheel clutch so that said apparatus is capable of unidirectional propulsion by said person while exercising in said prone position.

3. The exercise apparatus according to claim 1, further comprising:

a damper assembly adapted to limit a range of said collapsing motion, said damper assembly including a transverse damper frame capable of spanning a predetermined distance between said first and second axles, said frame having:

oppositely aligned end members joined end-to-end with a longitudinal member, wherein each of said end members includes a distal face adapted for securely biasing against said first and second axles; and a rolling horizontal support element, having:

an upper surface configured to support the ventral torso of said person;

a lower surface connected to said longitudinal member;

a vertical bracket including an upper portion connected to the lower surface of the rolling horizontal support element; and a third axle and wheel assembly;

wherein said vertical bracket further includes a lower portion defining a plurality of holes capable of receiving said third axle and wheel assembly.

4. The exercise apparatus according to claim 2, wherein said clutch is a sprag clutch.

5. A wheeled exercise apparatus comprising:

a first axle;

a second axle;

a first pair of opposing wheel assemblies disposed on the first axle;

a second pair of opposing wheel assemblies disposed on the second axle; and at least two resistance members coupling the first axle to the second axle, wherein the first axle and the second axle have a collapsed position and an extended position and the first axle and the second axle are coupled together only by the at least two resistance members when the first and second axles are in the extended position.

6. The apparatus of claim 5, further comprising:

a damper assembly capable of coupling the first axle and the second axle when the first axle and the second axle are in the collapsed position.

7. The apparatus of claim 6, wherein the damper assembly is fixedly coupled to the first axle, the damper assembly being selectively separable from the second axle when the first axle and the second axle move from the collapsed position to the extended position.

8. The apparatus of claim 5, wherein the first pair of opposing wheel assemblies further comprises:

a clutch mechanism having at least one of a freewheel rotation mode and a unidirectional rotation mode.

9. The apparatus of claim 8, wherein the clutch mechanism comprises:

a sprag clutch.

10. The apparatus of claim 5, further comprising:

a damper frame spanning a predetermined distance between the first axle and the second axle when in the collapsed position, the damper frame including:

a first end member and a second end member located opposite from the first end member;

a longitudinal member spanning substantially from the first end member to the second end member; and a rolling horizontal support element rigidly coupled to the longitudinal member and including an upper surface for supporting a user's torso thereon.

11. The apparatus of claim 5, further comprising:

a plurality of resistance bands of a predetermined peak resistance, the plurality of resistance bands removably coupled to the first axle and the second axle.

12. The apparatus of claim 5, wherein: each of the first and second axles having a plurality of pin formations at each end thereof, proximal to each wheel assembly; and the at least two resistance members each define a plurality of apertures spanning a length of the at least two resistance members, the plurality of apertures sized and shaped to receive the plurality of pin formations therein.

13. The apparatus of claim 5, wherein the first wheel axle further comprises:

a pair of end portions each having a tubular section defining an aperture for receiving a fastener therein.

14. The apparatus of claim 5, further comprising:

a handle grip coupled to the first axle.

15. A wheeled exercise apparatus comprising:

a first axle and a second axle each including a pair of removable wheel assemblies disposed on opposite ends thereof;

at least two resistance members coupling the first axle to the second axle, wherein the first axle and the second axle have a collapsed position and an extended position and the first axle and the second axle are coupled together only by the at least two resistance members when in the extended position;

and a foot supporting assembly coupled to the second axle and configured to support a person's feet.

16. The apparatus of claim 15, further comprising:

the damper assembly capable of coupling the first axle and the second axle when the first axle and the second axle are in the collapsed position.

17. The apparatus of claim 15, further comprising:

a damper frame spanning a predetermined distance between the first axle and the second axle, the damper frame including:

a first end member and a second end member located opposite from the first end member;

a longitudinal member spanning substantially from the first end member to the second end member; and a rolling horizontal support element rigidly coupled to the longitudinal member and including an upper surface for supporting a user's torso thereon.

18. The apparatus of claim 15, further comprising:

a clutch mechanism having at least one of a freewheel rotation mode and a unidirectional rotation mode.

19. The apparatus of claim 18, wherein the clutch mechanism comprises:

a sprag clutch.

* * * * *